US007641944B2

(12) United States Patent
Ichimura et al.

(10) Patent No.: US 7,641,944 B2
(45) Date of Patent: Jan. 5, 2010

(54) METHOD FOR FORMING GOLD PLATING

(75) Inventors: Masaya Ichimura, Nagoya (JP); Kanji Masui, Okazaki (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 616 days.

(21) Appl. No.: 10/895,498

(22) Filed: Jul. 21, 2004

(65) Prior Publication Data

US 2005/0023248 A1 Feb. 3, 2005

(30) Foreign Application Priority Data

Jul. 28, 2003 (JP) ..... 2003-280964
Jul. 16, 2004 (JP) ..... 2004-210430

(51) Int. Cl.
*B05D 1/18* (2006.01)
*B05D 3/06* (2006.01)

(52) U.S. Cl. ..... 427/553; 427/554; 427/556; 427/435; 427/436; 427/437

(58) Field of Classification Search ..... 427/553, 427/554, 556, 435, 436, 437
See application file for complete search history.

(56) References Cited

U.S. PATENT DOCUMENTS 4,009,297 A * 2/1977 Redmond et al. ..... 427/558
4,349,583 A * 9/1982 Kulynych et al. ..... 427/581
4,426,442 A * 1/1984 Molenaar et al. ..... 430/413
4,497,692 A * 2/1985 Gelchinski et al. ..... 205/92
4,578,157 A * 3/1986 Halliwell et al. ..... 205/86
4,877,644 A * 10/1989 Wu et al. ..... 427/556
4,963,974 A * 10/1990 Ushio et al. ..... 257/750
5,111,023 A * 5/1992 Horibe et al. ..... 219/121.85
5,292,418 A * 3/1994 Morita et al. ..... 204/224 R
5,405,656 A * 4/1995 Ishikawa et al. ..... 427/500
6,001,175 A * 12/1999 Maruyama et al. ..... 117/102
7,291,380 B2 * 11/2007 Nyholm et al. ..... 428/209

FOREIGN PATENT DOCUMENTS

JP 50-092830 7/1975
JP 62-196378 A 8/1987
JP 63-105972 A 5/1988
JP 06-280031 A 10/1994
JP 10-324589 A 12/1998
JP 2000-144437 A 5/2000
JP 2002-004060 A 1/2002

(Continued)

OTHER PUBLICATIONS

Von Gutfeld, Robert J., et al., "Laser Enhanced Plating". Gold Bull., 1982, 15 (4), pp. 120-123.*

(Continued)

*Primary Examiner*—Bret Chen
(74) *Attorney, Agent, or Firm*—Crompton, Seager & Tufte, LLC

(57) ABSTRACT

A method for forming gold plating. The method includes preparing a solution containing gold ions and a reductant, immersing an object that is to be plated in the solution, irradiating the object with ultraviolet rays, and depositing gold on the object to form gold plating when the ultraviolet rays cause a photochemical reaction in the solution.

25 Claims, 4 Drawing Sheets

FOREIGN PATENT DOCUMENTS

| | | | |
|---|---|---|---|
| JP | 2002-020108 | A | 1/2002 |
| JP | 2002-161369 | A | 6/2002 |
| JP | 2002-164368 | A | 6/2002 |
| JP | 2002-226975 | A | 8/2002 |

OTHER PUBLICATIONS

Von Gutfeld, R. J., "Laser-enhanced patterning using photothermal effects: maskless plating and etching". J. Opt. Soc. Am. B/vol. 4, No. 2/Feb. 1987, pp. 272-280.*

Nagamine, S. et al., "Laser Enhanced Electroless Gold Plating on Polyimide Resin Film". Hyomen gijutsu, 1998, vol. 49, No. 12, pp. 1305-1309. Abstract Only.*

Koichi, Kobayakawa, et al., "Laser Enhanced Electroless Gold Plating on Polyimide Film". Chemical Industry, vol. 51, No. 3, pp. 193-198 (2000). Abstract Only.*

Niidome, Yasuro, et al., "Novel Method for Spatioselective Electroless Plating Catalyzed by Laser-Deposited Gold Nanoparticles". Jpn. J. Appl. Phys., vol. 42, (2003), pp. 7640-7641.*

Mafune, Fumitaka, et al., "Formation of small gold clusters in solution by laser excitation of interband transition". Chemical Physics Letters 372 (2003), pp. 199-204.*

Khmyl, A.A., et al., "Effect of Optical Radiation in Local Formation of Thin Films by an Electrochemical Method". Journal of Applied Spectroscopy, vol. 63, No. 3, 1996.*

Zouari, I et al., "Zinc Electrodeposition Assisted by a Pulsed YAG Laser Beam: Effects of Hydrodynamic Conditions," *J. Electrochem. Soc.*, vol. 139, No. 8, Aug. 1992, p. 2163.

* cited by examiner

METHOD FOR FORMING GOLD PLATING

BACKGROUND OF THE INVENTION

The present invention relates to a method and apparatus for forming gold plating by performing photodeposition.

Gold plating has satisfactory anti-corrosion and superior electrical characteristics. Thus, gold plating is often applied to electrodes or contacts of electronic components. The gold plating is formed by performing electroplating or electroless plating. When performing electroplating, the object that is plated functions as a cathode. Thus, the plating object must be conductive. Accordingly, the plating object is a conductive body made of a conductive metal or an insulative body coated with a conductive film.

Compared to electroplating, electroless plating (chemical plating) is more advantageous in that electric current is not required to flow through the plated object when plating the object.

There have been experiments in which light was irradiated when plating metal (I. Zouari, F. Lapocque, M. Calvo, and M. Cabrera: J. Electrochem. Soc. 139 (1992) p. 2163). However, the light was used to mainly generate heat and increase the deposition rate.

When performing electroless plating, the parameters of metal deposition are the type of metal compound, the oxidation reduction potential of a reductant in a plating liquid, and the rate of reaction between the metal compound and the reductant. The parameters are changed to control the deposition of metal when immersing the object that is to be plated in the plating liquid. When locally plating an object, the object must be locally masked.

It is an object of the present invention to provide a method for easily forming gold plating on an object regardless of whether or not the plated object is made of a conductive material and regardless of whether or an object must be plated locally or entirely. It is another object of the present invention to provide an inexpensive apparatus for forming gold plating.

One aspect of the present invention is a method for forming gold plating on an object. The method includes preparing a solution containing gold ions and a reductant, immersing the object that is to be plated in the solution, irradiating the object with ultraviolet rays, and depositing gold on the object to form gold plating when the ultraviolet rays cause a photochemical reaction in the solution.

Another aspect of the present invention is a method for forming gold plating on an object. The method includes preparing a solution containing purified water, tetrachloroauric acid for providing gold ions, sodium sulfite serving as a reductant, and diluted sulfuric acid for adjusting the pH value of the solution. The method further includes immersing the object that is to be plated in the solution, irradiating the object with ultraviolet rays, and depositing gold on the object to form gold plating when the ultraviolet rays cause a photochemical reaction in the solution.

A further aspect of the present invention is an apparatus for forming gold plating on an object. The apparatus includes a tank for accommodating a solution containing gold ions. A support is arranged in the tank for immersing the object that is to be plated in the solution. A light source irradiates ultraviolet rays toward the object.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
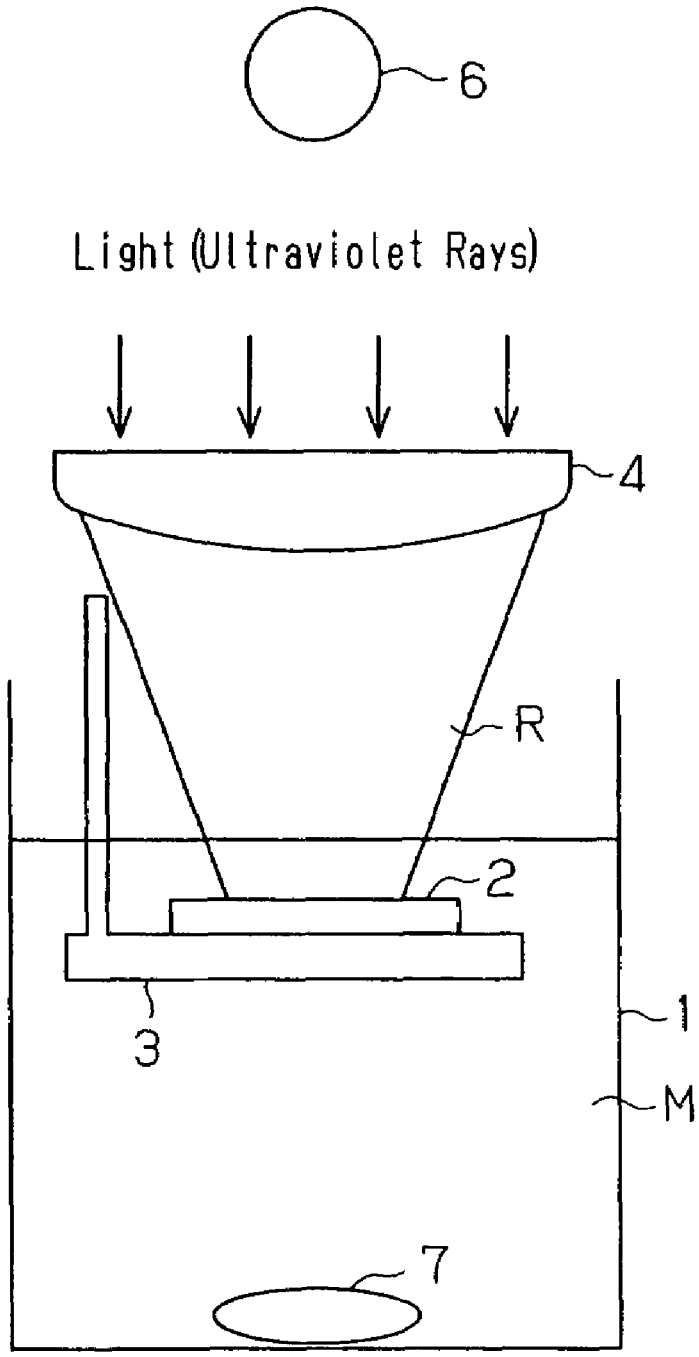
FIG. 1 is a schematic diagram showing an apparatus for forming gold plating according to a preferred embodiment of the present invention.

FIG. 1 shows an apparatus for forming gold plating according to a preferred embodiment of the present invention. The apparatus includes a tank 1 containing a solution M that includes gold ions and a reductant. A support 3 is arranged in the tank 1 below the surface level of the solution M. A substrate 2, which serves as the object to be plated, is placed on the support 3. A light source 6 is arranged above the tank 1. A converging lens 4 is located between the light source 6 and the substrate 2. A rotor 7 (agitator) is arranged in the tank 1 to agitate the solution M. Range R defines the region in which gold plating forms.

Using the gold plating formation apparatus, light is irradiated from a mercury lamp, or the light source 6, to perform photochemical deposition (PCD) and form gold plating. In the preferred embodiment, the composition of the solution M is as described below.

water: purified water tetrachloroauric acid ($HAuCl_4$): 0.006 mol/liter sodium sulfite ($Na_2SO_3$): 0.004 mol/liter Diluted sulfuric acid ($H_2SO_4$) was used to adjust the pH value of the solution to 1.0. The main chemical species in the above solutions are $Na^+$, $Au^{3+}$, $SO_4^{2-}$, and $SO_3^{2-}$. Further, the solution is acidic. Thus, $H^+$ is also included in the solution.

Light transmission of the solution M will now be described with reference to FIG. 2, which shows the percentage of light transmission in different types of solutions before performing PCD. The percentage of light transmission was plotted when the solution contained only Au (tetrachloroauric acid). The percentage of light transmission was also plotted when the solution contained sulfite, which serves as a reductant, in addition to Au. The difference between the absorbing characteristic profiles of the solutions shows that light of shorter wavelengths is absorbed when sulfite is added. Before the deposition of gold, the solution including sulfite absorbs light having a wavelength of 450 nm or less. Such light includes ultraviolet rays. Thus, this solution absorbs ultraviolet rays from the mercury lamp. It is believed that the existence of $SO_3^{2-}$ with $Au^{3+}$ in the solution shortened the wavelength of the absorption edge for the solution.

To form gold (Au) from the solution, $Au^{3+}$ must be changed to Au. It is believed that reactions represented by the following chemical formula (1) occurs in the acid solution.

$$Au^{3+}+3e^{-}\leftrightarrow Au \quad (1)$$

From equation (1), it is believed that $Au^{3+}$ is supplied with electrons so that the Au ion is reduced.

Further, when performing PCD, there are no electrons that are provided from outside the tank 1. Therefore, in this case, electrons are provided from $SO_3^{2-}$ of the reductant. The transfer of electrons between the gold ions $Au^{3+}$ and $SO_3^{2-}$ of the reductant is activated by the photoexcitation of the reductant, the gold ions, or both the reductant and gold ions. Most of the reduced metal atoms are deposited on the substrate 2, which functions as a location of heterogeneous nucleation. Accordingly, the substrate 2, or the plated object, does not have to be conductive since electric current is not used to form gold plating.

Figure 2:
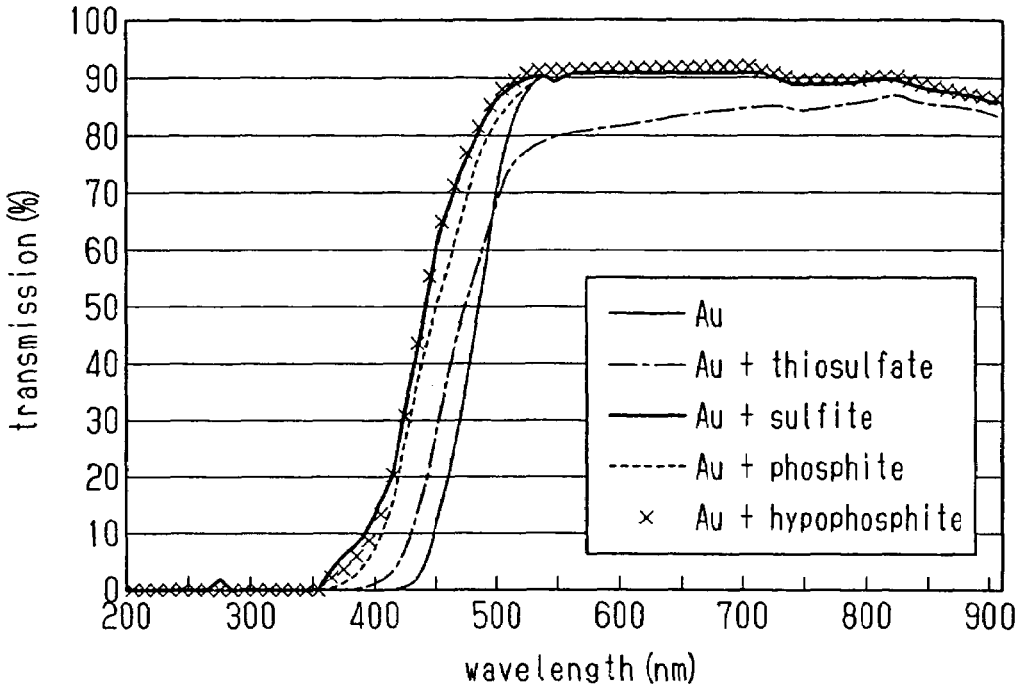
FIG. 2 is a graph showing the light transmission percentage of solutions used to form gold plating prior to photochemical deposition (PCD)

The graph of FIG. 2 also shows the light transmission of solutions that contained, in addition to Au, thiosulfate, phosphite, or hypophosphite, serving as a reductant. In the first solution, the concentration of thiosulfate ions was 0.0002 mol/liter. In the second solution, the concentration of phosphite ions was 0.0023 mol/liter. In the third solution, the concentration of hypophosphite ions was 0.0085 mol/liter. Each of these solutions also contained tetrachloroauric acid ($HAuCl_4$) at a concentration of 0.006 mol/liter. The pH value of each solution was also adjusted to 1.0. As apparent from FIG. 2, the addition of these reductants to Au also shortens the wavelength of the absorption edge for the solution. Accordingly, the solution is stable as long as light of certain wavelengths is not irradiated. This enables reactions that would be caused by lighting in a room to be ignored. Further, photochemical reactions are limited to the regions irradiated with light. Thus, selective formation of gold plating is enabled at predetermined regions. This is advantageous when patterning an object that is to be plated.

When adding sulfite to Au, the concentration of Au ions may be 0.003 mol/liter, the concentration of sulfite ions may be 0.015 to 0.02 mol/liter, and the pH value may be adjusted to 2.5. Under such conditions, gold and sulfite ions form a complex and stabilize. It is believed that photoexcitation of the complex causes the deposition of gold. Further, in the above solutions that add hypophosphite, phosphite, thiosulfate, or sulfite to Au, spontaneous gold deposition may occur when the amount of reductant is excessive or when the solution temperature increases. However, this case is advantageous in that spontaneous gold deposition does not occur in such a manner and the possibility of spontaneous reaction occurring is small.

In the preferred embodiment, when PCD is performed, the reaction that occurs in the solution is controlled by light and not by the amount of current or solvent. Further, the deposition that occurs through PCD forms gold plating.

As described above, the formation of the gold plating requires a solution including gold ions. Further, an appropriate reductant is dissolved in purified water to produce the solution, which includes gold ions.

Gold ions may be originated from tetrachloroauric acid ($HAuCl_4$) or sodium tetrachloroaurate ($NaAuCl_4$). However, gold ions do not necessarily have to be originated from these chemical compounds and may also be originated from a cyanoid, ammonium, or sulfate aurate. It is only required that stable gold ions be included in the solution.

The amount (concentration) of gold ions is required to be such that the formation of gold plating with sufficient thickness is enabled. When the concentration of gold ions is less than 0.001 mol/liter, the formation of the gold plating is not satisfactory. That is, deposition may not occur and the rate of deposition may be too slow. Further, when the concentration of the gold ions exceeds 0.01 mol/liter, the photochemical reaction becomes instable and spontaneous reaction starts to occur. Thus, the preferable concentration of gold ions is 0.001 to 0.01 mol/liter. For the formation of a further satisfactory gold plating, the concentration of gold ions is more preferably 0.003 to 0.006 mol/liter.

The concentration of the reductant may be 0.0001 to 0.1 mol/liter. When the concentration of the reductant is less than 0.0001 mol/liter, the amount of reductant becomes too small. This causes the formation of gold plating to become unsatisfactory. That is, deposition may not occur and the rate of deposition may be too slow. When the concentration of the reductant exceeds 0.1 mol/liter, the photochemical reaction becomes unstable and spontaneous reaction starts to occur. The reductants that may be used will now be described.

Sodium hypophosphite ($NaPH_2O_2$) may be used to provide hypophosphite ions $PHO_2^{2-}$. The preferred concentration of the hypophosphite ions is 0.005 to 0.1 mol/liter.

Sodium phosphite ($Na_2HPO_3$) may be used to provide phosphite ions $PHO_3^{2-}$. The preferred concentration of the hypophosphite ion is 0.005 to 0.1 mol/liter.

Sodium thiosulfate ($Na_2S_2O_3$) may be used to provide thiosulfate ions $S_2O_3^{2-}$. The optimal concentration of the thiosulfate ions is 0.0002 mol/liter. When the concentration of the thiosulfate ions reaches approximately 0.1 mol/liter, the gold ions and thiosulfate ions form a complex and stabilize. Photochemical deposition is also enabled in this state.

Further, as described above, sodium sulfite($Na_2SO_3$) may be used to provide sulfite ions $SO_3^{2-}$. The preferred concentration of the sulfite ions is 0.004 mol/liter.

It is preferred that the pH value of the solution be in the range of $-2<pH\leqq 6$. Photochemical reactions occur stably when the pH value is in this range. However, photochemical reactions becomes unstable when the pH value is outside this range. More specifically, precipitations are generated when the pH value exceeds 6, and the photochemical reactions become unstable when the pH value is less than −2.

The concentration of the solution, the depth of the substrate 2 in the tank 1, and the agitation strength of the solution may affect the plating formation rate. However, the plating formation rate may easily be controlled by activating and inactivating the light source 6 and by adjusting the intensity of the light irradiated from the light source 6. Further, the substrate 2 on which the gold plating is to be deposited may be made of any material. For example, the substrate 2 may be made of silicon, plastic, glass, ceramic, or metal.

When performing PCD on a silicon (Si) substrate or a plastic substrate, the substrate does not have to undergo a pre-treatment since silicon and plastic substrates absorb ultraviolet rays that activate there surfaces and enhance nucleation of the gold plating. However, when performing PCD on a glass substrate, the substrate must undergo catalytic treatment using Pd or the like or activation treatment using acid. By performing catalytic treatment using Pd or the like or activation treatment using acid on the surface of a substrate that does not absorb ultraviolet rays, a metal plating may easily be deposited on the treated regions that is irradiated with light. Thus, a substrate made of any material may be used.

As described above, the gold plating formation apparatus used to perform PCD in the preferred embodiment is formed by the tank 1, which contains the solution including gold ions, and the support 3, which is used to immerse the substrate 2 in the solution. The apparatus also includes the light source 6 that irradiates light having a wavelength of 450 nm or less toward the substrate 2.

The light source 6 is faced downward toward the substrate 2 to directly irradiate the substrate 2 with light. However, the location of the light source 6 may be changed by using, for example, an aluminum coated mirror to reflect the light of the light source 6 toward the substrate 2. It is preferred that the converging lens 4 be arranged between the substrate 2 and the light source 6 to converge light in accordance with the size of the substrate or the area that is to undergo deposition. This would enable the generation of a deposition reaction only in the desired region. Accordingly, the convergence of light with the converging lens 4 would enable gold plating to be formed selectively on part of the substrate 2. The gold plating that is formed may be used as an electrode or a wire.

Further, to form gold plating selectively on part of the substrate 2, a mask may be arranged between the light source 6 and the substrate 2. The rotor 7 is arranged in the tank 1 to agitate the solution and enhance the reaction of gold ions on the substrate 2. The support 3 of the substrate 3 may include a lifting mechanism employed to adjust the immersion depth of the substrate 2 from the surface level of the solution. The above apparatus that performs PCD is simple in comparison to an apparatus that performs electroplating or chemical plating. Thus, the apparatus that performs PCD may be enlarged to produce large products.

An ultraviolet laser light source may also be employed as the light source 6. The ultraviolet laser light source would enable the formation of finer gold plating patterns.

In the preferred embodiment, gold plating is formed on the substrate 2. However, the plated object does not necessarily have to be the substrate 2 and may be, for example, an ornamental object.

EXAMPLE 1

A test was conducted to analyze the formation of gold plating. The solution included $HAuCl_4$ and sodium hypophosphite ($NaPH_2O_2$) dissolved in purified water. The concentration of $HAuCl_4$ was 0.006 mol/liter, and the concentration of $NaPH_2O_2$ was 0.004 mol/liter. Diluted sulfuric acid ($H_2SO_4$) was used to adjust the pH value of the solution to 1.0.

A degreased, vinyl chloride substrate having dimensions of 1.5 cm×1.0 cm was immersed in the solution at a depth of approximately 3 mm from the surface level of the solution. A converging lens 4 converged the light of a high-pressure mercury lamp (light source) to irradiate the substrate with the converged light from above. The diameter of the irradiation region was 10 mm. The solution was agitated by the rotor 7 at a constant speed during deposition. The deposition time was four hours. As a result, gold plating having a thickness of approximately 0.8 μm was deposited on the side of the substrate that was irradiated with light. Subsequent to the deposition, the sample (substrate) was washed with purified water and dried naturally.

An X-ray photoelectron spectroscopy (XPS) analysis and X-ray diffraction (XRD) analysis was conducted on the sample that had undergone PCD. The X-ray diffraction was measured using the Kα rays of a Cu tube.

Figure 3:
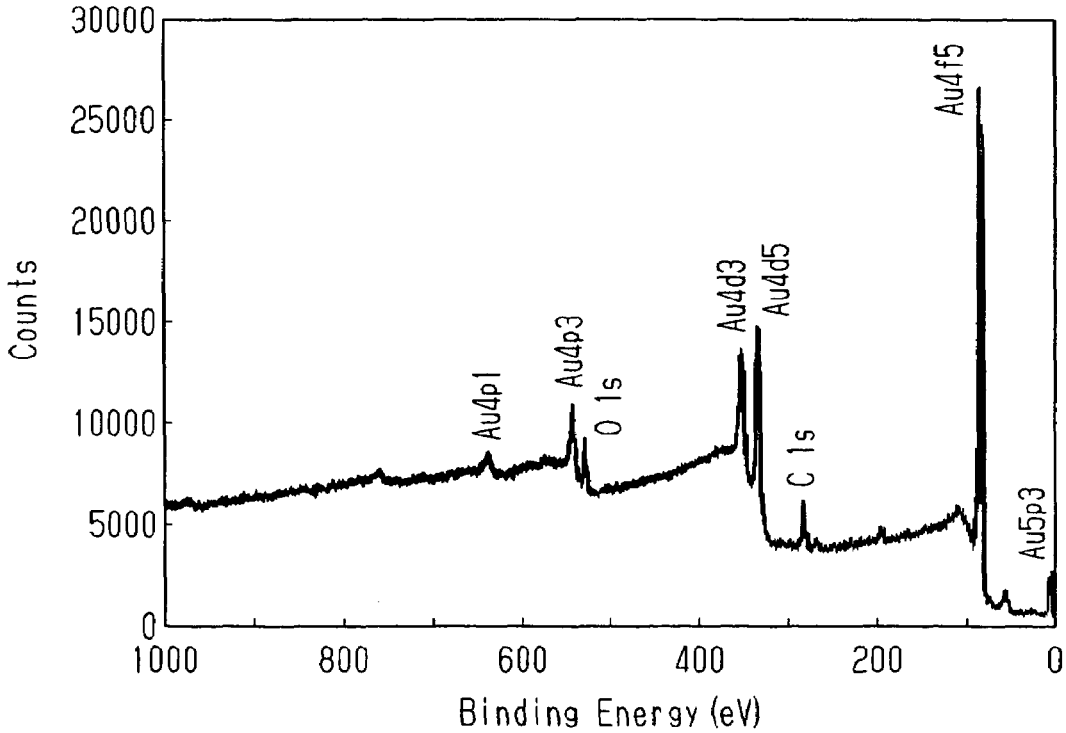
FIG. 3 is a graph showing the X-ray photoelectron spectral characteristics of gold plating measured by X-ray photoelectron spectroscopy (XPS)
Figure 4:
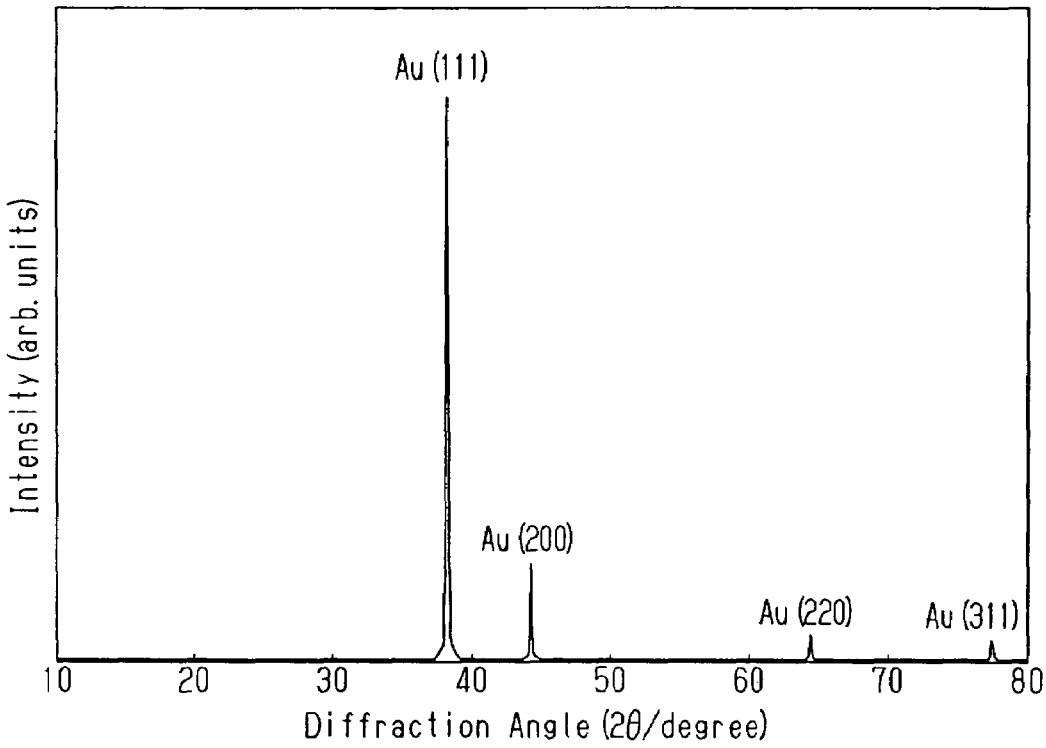
FIG. 4 is a graph showing the X-ray diffraction (XRD) spectral characteristics of gold plating.

FIG. 3 shows the spectrum that was obtained by conducting the XPS analysis on the sample. FIG. 4 shows the result of the XRD analysis. The XPS analysis confirmed substantially pure gold although a slight amount of oxygen and carbon was detected. The detected oxygen and carbon is believed to be due to surface contamination. The XRD analysis confirmed the main diffraction peaks for gold, such as (111) and (200) diffractions.

EXAMPLE 2

A further test was conducted to analyze the formation of gold plating. The solution included $HAuCl_4$ and sodium sulfite ($Na_2SO_3$) dissolved in purified water. The concentration of $HAuCl_4$ was 0.003 mol/liter, and the concentration of $Na_2SO_3$ was 0.018 mol/liter. Diluted sulfuric acid ($H_2SO_4$) was used to adjust the pH value of the solution to 2.6.

A degreased, vinyl chloride substrate having dimensions of 1.5 cm×1.0 cm was immersed in the solution at a depth of approximately 3 mm from the surface level of the solution. A converging lens 4 converged the light of a high-pressure mercury lamp (light source) to irradiate the substrate with the converged light from above. The diameter of the irradiation region was 10 mm. The solution was agitated by the rotor 7 at a constant speed during deposition. The deposition time was one hour. As a result, gold plating having a thickness of approximately 0.5 μm was deposited on the side of the substrate that was irradiated with light. Subsequent to the deposition, the sample (substrate) was washed with purified water and dried naturally.

The X-ray photoelectron spectroscopy (XPS) analysis and X-ray diffraction (XRD) analysis was conducted on the sample that had undergone PCD. The X-ray diffraction was measured using the Kα rays of a Cu tube.

Figure 5:
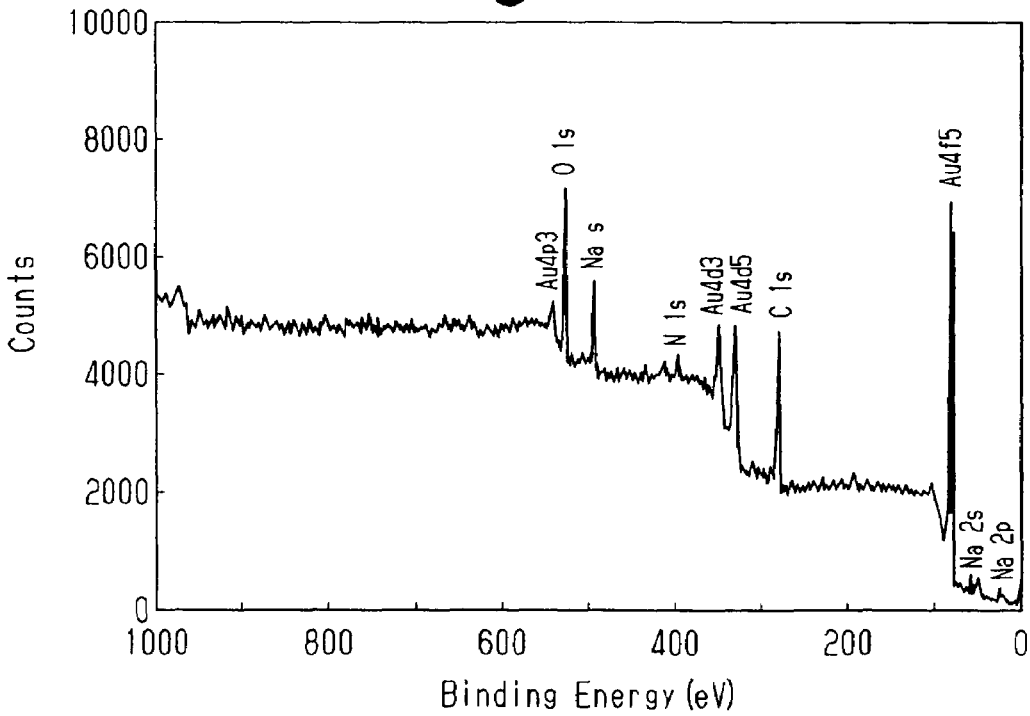
FIG. 5 is a graph showing the X-ray photoelectron spectral characteristics of gold plating measured by X-ray photoelectron spectroscopy (XPS)
Figure 6:
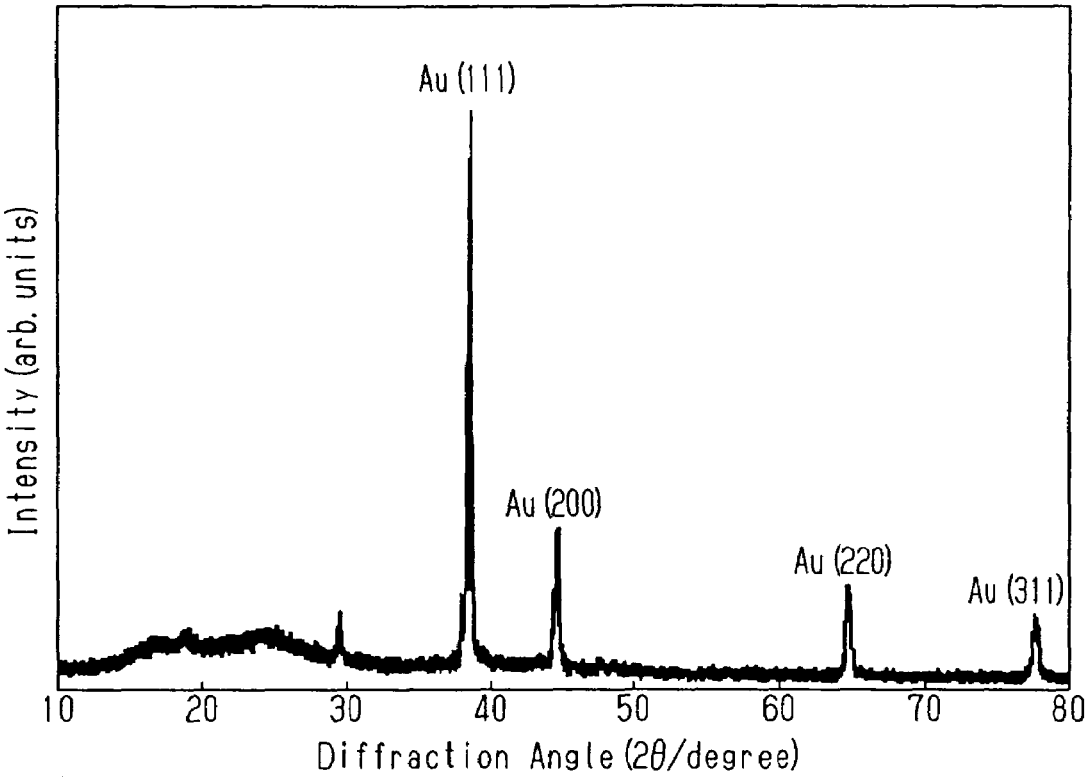
FIG. 6 is a graph showing the X-ray diffraction (XRD) spectral characteristics of gold plating.

FIG. 5 shows the spectrum that was obtained by conducting the XPS analysis on the sample. FIG. 6 shows the result of the XRD analysis. The XPS analysis confirmed that the deposition was pure gold although a slight amount of oxygen and carbon was detected. The detected oxygen and carbon is believed to be due to surface contamination. The XRD analysis confirmed the main diffraction peaks for gold, such as (111) and (200) diffractions.

The advantages of the preferred embodiment are described below.

(a) The apparatus for forming gold plating that performs PCD is simple and inexpensive. Further, the apparatus may easily be enlarged.

(b) The time and region of photochemical reactions may be controlled by using light. In other words, the photochemical reactions may be stopped by stopping the irradiation of light and started by starting the irradiation of light. Further, reactions may be caused to occur locally (e.g., only on the object that is to be plated) by converging light.

(c) The plated object does not necessarily have to be conductive and may be non-conductive, or insulative. Thus, the plated object may be made from various substances.

(d) Photochemical reactions do not occur spontaneously in the solution unless the solution is irradiated with light. This facilitates the storage of the solution.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope and equivalence of the appended claims.

What is claimed is:

1. A method for forming gold plating on an object, the method comprising:

preparing a solution containing gold ions and a reductant;

immersing the object that is to be plated in the solution;

irradiating the solution and the object with ultraviolet rays so that the solution absorbs the ultraviolet rays; and depositing gold on the object to form gold plating when the ultraviolet rays absorbed in the solution cause a photochemical reaction in the solution in which transfer of electrons between the gold ions and the reductant is activated by the photoexcitation of the gold ions, the reductant, or both the gold ions and the reductant, wherein the photochemical reaction is started in the solution when starting the irradiation of the ultraviolet rays and is stopped when stopping the irradiation of the ultraviolet rays.

2. The method according to claim 1, wherein the object is made of a material of which surface absorbs ultraviolet rays and becomes active so as to enhance nucleation for gold plating; and the object is a substrate on which reduced gold ions are deposited and functions as a location of heterogeneous nucleation.

3. The method according to claim 1, wherein the object is insulative.

4. The method according to claim 1, wherein the object is conductive.

5. The method according to claim 1, wherein said preparing a solution includes preparing the solution so that the concentration of the gold ions is 0.001 to 0.01 mol/liter.

6. The method according to claim 1, wherein said preparing a solution includes containing one of tetrachloroauric acid and sodium tetrachloroaurate in the solution.

7. The method according to claim 6, wherein said preparing a solution includes preparing the solution so that the concentration of tetrachloroauric acid is approximately 0.006 mol/liter.

8. The method according to claim 1, wherein the gold ions include Au3+.

9. The method according to claim 1, wherein said preparing a solution includes preparing the solution so that the concentration of the reductant is 0.0001 to 0.1 mol/liter.

10. The method according to claim 1, wherein said preparing a solution includes containing one of hypophosphite, phosphite, thiosulfate, and sulfite as the reductant in the solution.

11. The method according to claim 10, wherein said preparing a solution includes preparing the solution so that the concentration of hypophosphite is 0.005 to 0.01 mol/liter.

12. The method according to claim 10, wherein said preparing a solution includes preparing the solution so that the concentration of phosphite is 0.005 to 0.01 mol/liter.

13. The method according to claim 10, wherein said preparing a solution includes preparing the solution so that the concentration of thiosulfate is 0.0002 mol/liter.

14. The method according to claim 10, wherein said preparing a solution includes preparing the solution so that the concentration of sulfite is 0.004 mol/liter.

15. The method according to claim 10, wherein said preparing a solution includes preparing the solution so that the concentration of sulfite is 0.015 to 0.02 mol/liter.

16. The method according to claim 1, wherein said preparing a solution includes adjusting the pH value of the solution to be greater than −2 and 6 or less.

17. The method according to claim 1, wherein said preparing a solution includes adding diluted sulfuric acid so that the pH value of the solution becomes substantially 1.0.

18. The method according to claim 1, wherein said preparing a solution includes adding diluted sulfuric acid so that the pH value of the solution becomes substantially 2.5.

19. A method for forming gold plating on an object, the method comprising:

preparing a solution containing purified water, tetrachloroauric acid for providing gold ions, sodium sulfite serving as a reductant, and diluted sulfuric acid for adjusting the pH value of the solution;

immersing the object that is to be plated in the solution;

irradiating the solution and the object with ultraviolet rays so that the solution absorbs the ultraviolet rays; and depositing gold on the object to form gold plating when the ultraviolet rays absorbed in the solution cause a photochemical reaction in the solution in which transfer of electrons between the gold ions and the reductant is activated b the photoexcitation of the gold ions, the reductant or both the gold ions and the reductant, wherein the photochemical reaction is started in the solution when starting the irradiation of the ultraviolet rays and is stopped when stopping the irradiation of the ultraviolet rays.

20. The method according to claim 19, wherein said preparing a solution includes preparing the solution so that the concentration of tetrachloroauric acid is 0.006 mol/liter, the concentration of sodium sulfite is 0.004 mol/liter, and the pH value of the solution is adjusted to substantially 1.0 with the diluted sulfuric acid.

21. The method according to claim 19, wherein said preparing a solution includes preparing the solution so that the concentration of tetrachtoroauric acid is 0.003 mol/liter, the concentration of sodium sulfite is 0.015 to 0.02 mol/liter, and the pH value of the solution is adjusted to substantially 2.5 with the diluted sulfuric acid.

22. The method according to claim 1, wherein said irradiating the solution and the object with ultraviolet rays comprises irradiating the solution and the object with ultraviolet rays from a mercury lamp.

23. The method according to claim 19, wherein said irradiating the solution and the object with ultraviolet rays comprises irradiating the solution and the object with ultraviolet rays from a mercury lamp.

24. The method according to claim 1, wherein the object comprises a substrate made of a material selected from the group consisting of silicon, plastic, glass, ceramic and metal.

25. The method according to claim 19, wherein the object comprises a substrate made of a material selected from the group consisting of silicon, plastic, glass, ceramic and metal.

* * * * *

UNITED STATES PATENT AND TRADEMARK OFFICE

CERTIFICATE OF CORRECTION

PATENT NO. : 7,641,944 B2
APPLICATION NO. : 10/895498
DATED : January 5, 2010
INVENTOR(S) : Masaya Ichimura et al.

It is certified that error appears in the above-identified patent and that said Letters Patent is hereby corrected as shown below:

Column 8
Line 31 Delete "tetrachtoroauric" and insert therefor -- tetrachloroauric --.

Signed and Sealed this

Fourth Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,641,944 B2
APPLICATION NO. : 10/895498
DATED : January 5, 2010
INVENTOR(S) : Masaya Ichimura et al.

It is certified that error appears in the above-identified patent and that said Letters Patent is hereby corrected as shown below:

Title page, item (*) Notice: should read as follows: Subject to any disclaimer, the term of this patent is extended or adjusted under 35 U.S.C. 154(b) by 1001 days.

Signed and Sealed this

Twenty-second Day of June, 2010

David J. Kappos

David J. Kappos
*Director of the United States Patent and Trademark Office*